US008429805B1

(12) United States Patent
Adkins

(10) Patent No.: US 8,429,805 B1
(45) Date of Patent: Apr. 30, 2013

(54) RAILING AND METHOD OF MANUFACTURE

(76) Inventor: Willard B. Adkins, Land O'Lakes, FL (US)

( * ) Notice: Subject to any disclaimer, the term of this patent is extended or adjusted under 35 U.S.C. 154(b) by 0 days.

(21) Appl. No.: 13/276,751

(22) Filed: Oct. 19, 2011

(51) Int. Cl.
*B23P 11/00* (2006.01)
*E04H 17/14* (2006.01)

(52) U.S. Cl.
USPC ..... 29/525.14; 256/65.02

(58) Field of Classification Search ..... 29/428, 29/525.14, 469, 525.01, 525.02; 256/65.02, 256/65.03, 65.04, 65.07, 65.1, 22, 65.11
See application file for complete search history.

(56) References Cited

U.S. PATENT DOCUMENTS 4,014,520 A * 3/1977 Walters ..... 256/22
4,968,005 A * 11/1990 Zen ..... 256/22
6,811,146 B1 * 11/2004 Giralt ..... 256/65.01
7,168,689 B2 * 1/2007 Giralt ..... 256/59

* cited by examiner

*Primary Examiner* — John C Hong
(74) *Attorney, Agent, or Firm* — Ronald E. Smith; Smith & Hopen, P.A.

(57) ABSTRACT

A picket or panel railing and method of fabrication of the railing from a kit of parts includes U-shaped channels having inserts fixed in the channels, with holes pre-formed in the insert for insertion of pickets. Vertical pickets interconnect the upper channel and a lower channel and opposite ends of the pickets fit through the holes formed in the inserts.

7 Claims, 5 Drawing Sheets

RAILING AND METHOD OF MANUFACTURE

BACKGROUND OF THE INVENTION

1. Field of the Invention

This invention relates to metal railings. More particularly, it relates to pedestrian and bicycle path guardrails having vertical pickets that interconnect horizontal top and bottom rails.

2. Brief Description of the Related Art

Pedestrian guardrails with vertical pickets are well-known. They are used in private and public works projects. Prior art railings are cut and welded in shop, then sent out to be hot dipped galvanized. The galvanized railings are and then shipped back to the manufacturer who ships them to the customer to be installed. The preassembled product sometimes has a length of ten linear feet but more typically is twenty linear feet. At twenty two pounds per linear foot, the product is very heavy and hard to handle.

Thus there is a need for a pedestrian guardrail structure that is not delivered to a job site in preassembled condition and which is instead made up of unassembled individual parts that are light in weight, easy to handle, and easy to assemble.

However, in view of the art at the time the invention was made, it was not obvious to those of ordinary skill how a structure could be made that did not require such cutting and welding.

SUMMARY OF THE INVENTION

The novel method of manufacturing a railing assembly includes a system of assembly that provides a railing assembly easily installed on a jobsite, with limited or no cutting and welding, thereby reducing labor costs and time for installation. The only cutting or welding required is on rare occasions when a part may need to be modified to fit a particular condition or to correct a fabrication mistake.

The upper and lower rail may be made of an identical length of a metal, such as steel or an aluminum alloy, or other materials. The shape of the lower and upper rail form an arcuate mid-region and a flat surface extending from one side of the arcuate mid-region that may be welded or attached with fasteners to a flat surface of an upright post mounted in a foundation. The post may be mounted on the foundation using bolts, without any welding, for example.

In one example, the flat surface of a horizontal rail is attached to a surface of a post using fasteners, instead of or in addition to welding, such as spot welding. In one example, the post includes a flat surface of an elongated I-beam, T-beam, or C-channel, which may include a cap that conceals nuts and completes the post. The flat surface facilitates fastening the posts to the lower and upper rails.

The flat structure of the post and rail eliminates the need for having to route, use coping, or to notch the post to fit the top and bottom rails as required in conventional railing systems.

Pickets may be inserted in pre-cut or pre-formed holes formed, punched or otherwise provided through inserts secured within the upper and lower rails. The inserts are positioned between a first flat surface that extends from a first side of the arcuate mid-region of the rails and a second flat surface on the opposite side of the rail that extends from a second side of the arcuate mid-region of the rails. In one embodiment, the upper and lower rails are symmetric and U-shaped, and the inserts have a flat mid-region and the opposite flanges extend in the same direction from the flat mid-region, thereby forming an open, rectangular channel. In another embodiment, the opening of the channel of the insert faces inwardly toward the arcuate mid-region of the rails, and pickets are inserted through the holes and into the cavity formed by the insert and the rail. In another embodiment, the opening of the channel faces outwardly away from the arcuate mid-region, forming a channel capable of receiving a panel. The panel may replace pickets in a railing and may include a sound barrier, a decorative motif used for advertisement or a transparent barrier, for example. The panel railing may be assembled similarly to the picket railing, except the panel is inserted into the opening of the channels of the inverted inserts between the upper rail and the lower rail.

Alternatively, the inserts may take the form of a rectangular tube or a capped channel, sized for fitting within the opposite sides of a U-shaped railing. A plurality of holes may be pre-cut or pre-formed, such as by punching, machining or forming, through the flat mid-region of each of the inserts, at a predetermined spacing, for example. The holes may accommodate the insertion of pickets, which are spaced along the pedestrian railing between the upper rail and the lower rail. A lower insert may be fitted into a lower rail, and an upper insert may be fitted into an upper rail. Both of the lower and upper inserts may be attached to the railings by welding, adhesive bonding, brazing, soldering or the like or may be attached by fasteners, such as screws or rivets or may be snap fit or interference fit into railings.

The railings may be made of a rigid and durable material, preferably capable of extended exposure and use outdoors. Metals such as steel and aluminum are preferable. A pedestrian railing made of dip-galvanized steel may be assembled from pre-manufactured components in the field. Alternatively, thermoplastic and thermosetting polymers may be used to form the various components of the railings, provided that strength and stiffness issues are addressed in the design of the components. A fiber-reinforced polymer resin is preferably used to form load bearing components of a non-metallic pedestrian railing, such that the stiffness and strength requirements of the load-bearing components are met using less polymer resin. In one embodiment, polymer resins used in the railing contain a substantial amount of recycled materials, meaning at least fifty percent (50%) recycled material in the railing, which recycled material may include regrind from manufacturing operations.

In one embodiment, a handrail is mounted above the upper rail at a distance that allows a user to see between the handrail and the upper rail, without any obstruction by a plurality of pickets extending between the upper rail and the lower rail. The handrail may be secured at its ends or along its length by a fixture, for example. Fixtures may be secured to the posts or the upper rail, or both.

In a method of assembly, a flat face of a horizontal lower rail is attached to upstanding posts mounted on foundations using fasteners passing through a hole in the flat face of the lower rail. A plurality of pickets are disposed in pre-cut or pre-formed holes in the lower insert, which is secured in the lower rail, prior to attaching the lower rail to the posts. A flat part of each of the posts is secured by the fasteners to the flat surface of the lower rail, prior to inserting the pickets into the holes in the lower insert. An upper rail is then mounted onto the railing. The upper rail has an upper insert with holes, and the pickets are inserted into the holes in the upper insert, prior to securing a flat face of the upper rail to the flat face of the posts, using fasteners. At this point, prior to fully tightening the fasteners, the upper and lower rails may be aligned substantially parallel to each other, the lower rail being aligned substantially parallel to the ground, for example. Once the fasteners are tightened, the upper and lower rails are secured to the posts and in relation to each other.

Optionally, a handrail may be mounted spaced apart from and above the upper rail, using fixtures attached to the posts, for example, completing a fully functional and aesthetically pleasing pedestrian railing.

In one example, the fasteners are bolts with nuts, and the bolts extend through the flat face of the upper and lower rails. The flat face of the posts and the nuts are tightened on the end of the bolt extending through the flat face of the posts to the opposite side of the flat face of the posts.

In all embodiments, a concealment plate makes the post complete. It conceals and protects the nuts from exposure, i.e., it denies access to the nuts so that the railing assembly may not be disassembled by unauthorized personnel.

One advantage of the railing assembly and method of manufacture is that the design is manufacturable from simple extrusions with minimal post extrusion machining, stamping and welding.

Another advantage is that the railing assembly may be installed by a crew in the field without any need for welding the components together during assembly. In one example, a cap or shield may be tack or spot welded post-assembly.

Yet another advantage is that time and labor costs for installing railing assemblies to complete a project are reduced compared to known railings that require cutting or more complicated assembly at the jobsite or more complicated welding operations and installation steps.

Still another advantage is that the costs of materials and assemblies are reduced compared to known railings due to efficiencies in use of materials and fabrication of the assemblies. Standardized components may be manufactured and shipped to a field site as needed for assembly at a field location. The ornamental design of the railings is highly attractive and distinctive without introducing substantial additional costs for materials and labor while substantially reducing such costs in comparison with known railings of comparable quality and aesthetic appeal.

Moreover, the novel structure can be assembled on site. This reduces the prior art need for additional equipment to transport to the site and the prior art need for additional equipment to move preassembled rail around the site.

BRIEF DESCRIPTION OF THE DRAWINGS

FIG. 3 is a side elevational view of an embodiment mounted on a concrete slab, pavement, sidewalk or the like;

DETAILED DESCRIPTION OF THE PREFERRED EMBODIMENT

The embodiments disclosed and the drawings rendered are illustrative and do not limit the scope of the invention as defined by the appended claims.

In the examples of FIGS. 1 A-C, an upper rail and a lower rail may have identical structures and be interchangeable one for the other. In one example, upper rail 26 and lower rail 26 are made of steel and are prefabricated with inserts 24 secured in rails 26, such as by welding of the inserts into the rails.

Figure 1A:
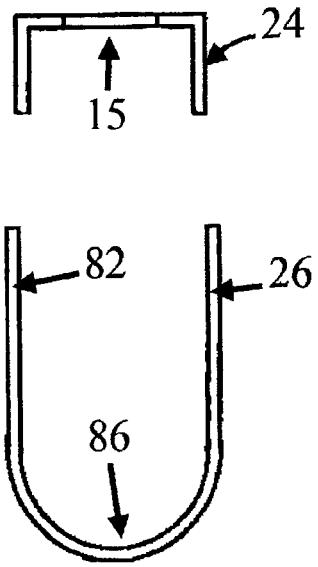
FIG. 1A is an exploded view of a rail that may be used as an upper or lower rail.
Figure 1B:
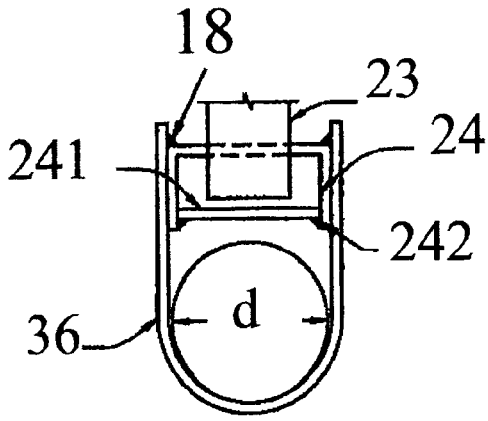
FIG. 1B depicts a welded structure.
Figure 1C:
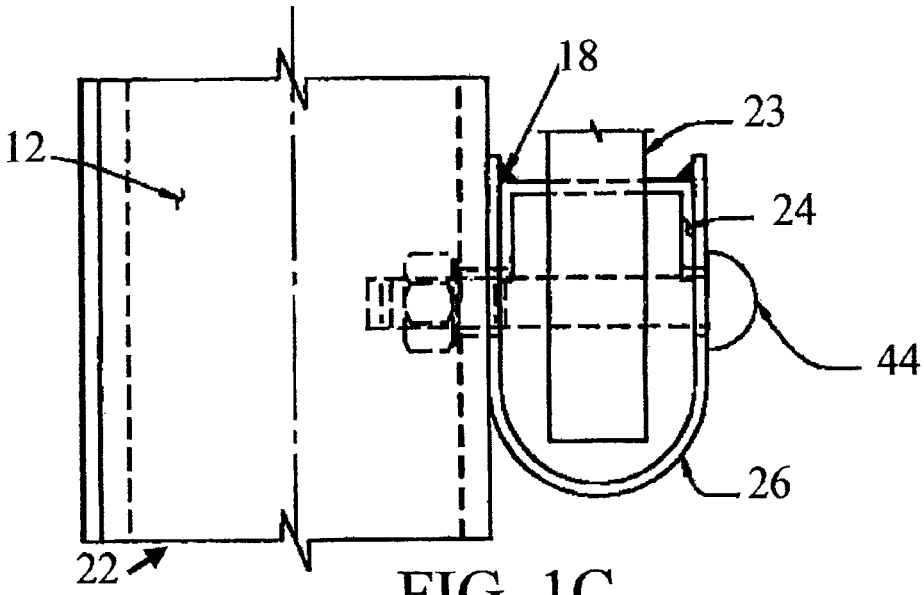
FIG. 1C depicts a welded structure mounted to a post.

A weld seam 18, which may be a continuous weld seam, a bead, a spot weld, a tack weld or the like, is depicted in FIGS. 1B and 1C. Seam 18 joins insert 24 to rail 26.

Both rails 26, 26 are depicted as U-shaped with arcuate portion 86 joining opposing, identical flat ends 82. Either flat end may be secured to the surface of a post 22, such as by fastener 44 depicted in FIG. 1C, which is shown extending through rail 26 and post 22 with dashed lines indicating features hidden from view.

Insert 24 may be a C-shaped channel having a plurality of holes or apertures 15 (FIG. 1A), said apertures being pre-cut or pre-formed and providing a predetermined spacing between pickets 23, when said pickets are inserted through said apertures 15 as depicted in FIGS. 1B and 1C.

Fastener 44 may be any suitable fastener. FIG. 1C depicts a bolt and nut in screw-threaded engagement. Rails 26, 26 and inserts 24 may be formed, extruded or otherwise manufactured in convenient lengths for use in assembling railings with picket 23 holes pre-cut, pre-punched or pre-drilled, for example. Holes for fasteners 44 may be provided in advance as well, or may be drilled during assembly.

Figure 2:
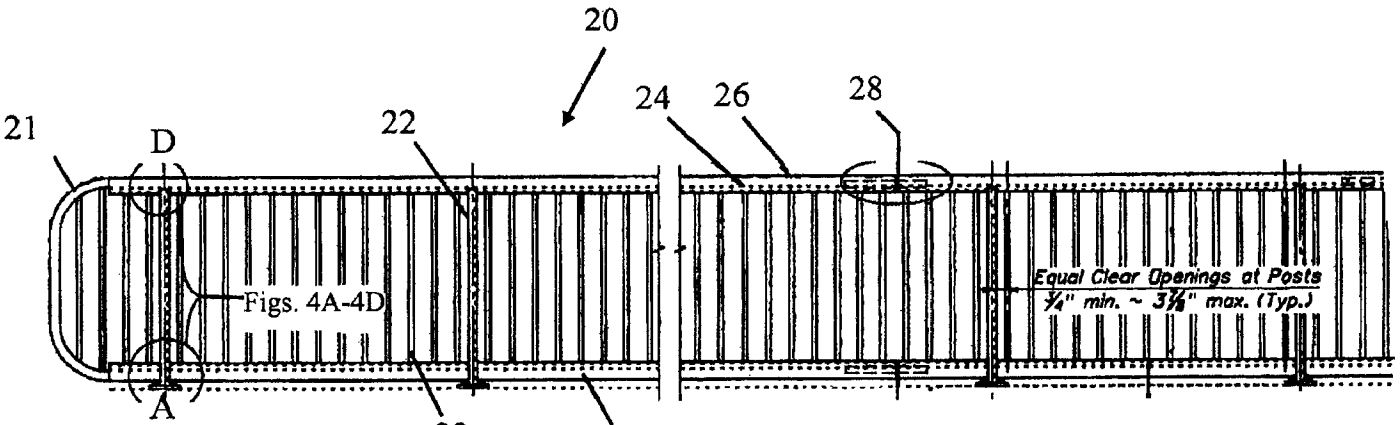
FIG. 2 is a side elevational view of one embodiment of an assembled railing.
Figure 3:
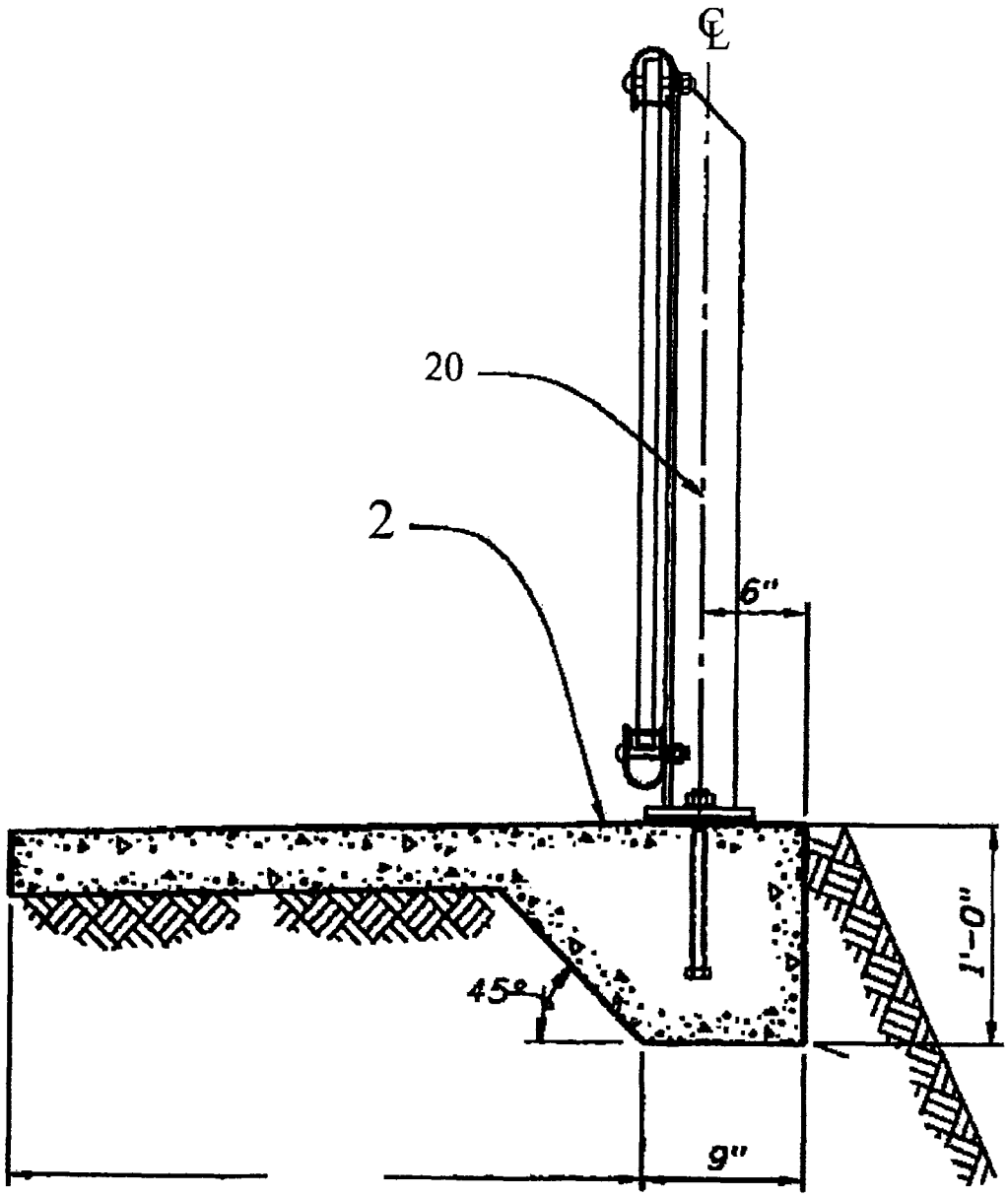

Assembly of a pedestrian railing, such as depicted in FIG. 2, may be completed by first pouring a slab, sidewalk, pavement or the like (denoted 2 in FIG. 3), which may include a fastener precast into the structure, as illustrated by the anchor bolt in FIG. 3, for example.

Figure 4A:
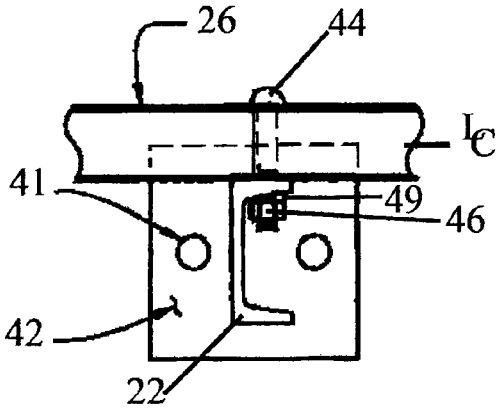
FIG. 4A is a partial top view of a pedestrian railing mounted on a C-beam post including a partial top view of a lower rail.
Figure 4B:
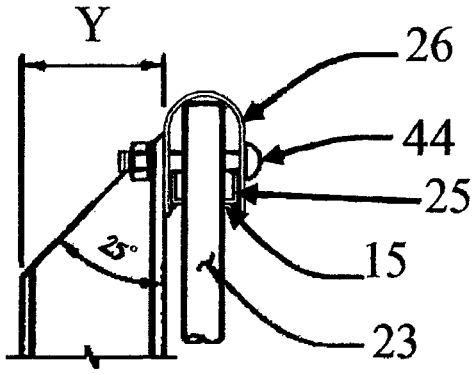
FIG. 4B is a partial side view of an upper rail.
Figure 4D:
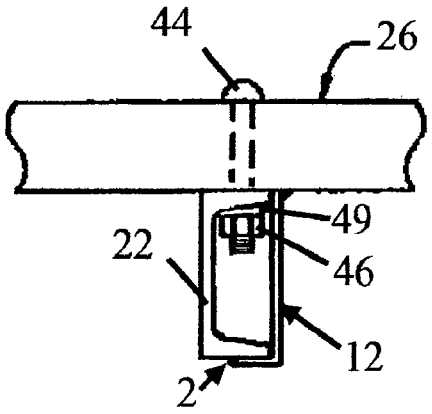
FIG. 4D is a partial top view of an upper rail.
Figure 4C:
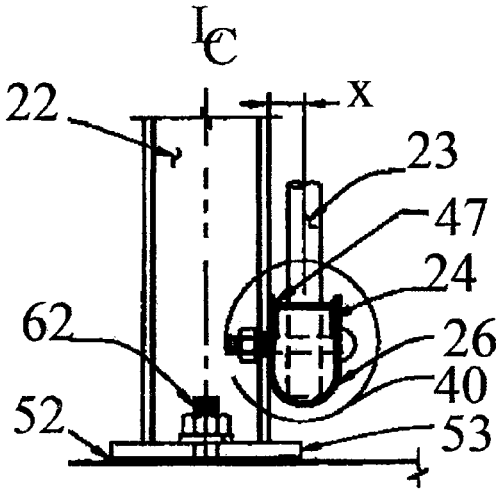
FIG. 4C is a partial side view of a lower rail.

As best understood in connection with FIGS. 4A-C, post 22 having a C-shaped cross section is welded to mounting plate 42 in surmounting and upstanding relation to said mounting plate. Apertures 41 (FIG. 4A) are formed in mounting plate 42 to receive a fastener such as an anchor bolt 62 (FIG. 4C), extending from a precast or poured support structure, such as the structure illustrated in FIG. 3, for example.

In FIG. 4A, lower rail 26 is fastened to post 22 using a round-head carriage bolt 44 that passes through U-shaped rail 26 and post 22, a portion of carriage bolt 44 engaging a square hole formed in rail 26. A threaded end of carriage bolt 44 passes through a hole in a side flange portion of C-beam post 22, and wedge-shaped washer 49 provides a flat surface for nut 46 to facilitate tightening of the nut on carriage bolt 44.

FIG. 4D depicts the same mounting arrangement for upper rail 26, which is identical to the lower rail, in this example.

Without access to nut 46, carriage bolt 44 may not be detached from the railing. Bolt 44 nondetachably fixes the rail to post 22 and said bolt cannot be removed when post 22 is capped by said cap 12. FIG. 4D depicts cap 12 welded onto post 22 such that nut 46 cannot be removed from carriage bolt 44. Cap 12, also known as concealment plate 12, is L-shaped and completes the top and side of channel-shaped post 22. The horizontal truncate part of concealment plate 12 completes the top of the post and the elongate vertical part completes the side. Channel post 22 has two small sections of angles welded to each side of the post for the cover plate to slide through, trapping concealment plate 12 on each side and the horizontal top of concealment plate 12 is secured by self tapping screws so that no welding is needed.

Upper and lower rail assembly 40, circled in FIG. 4C, is easy to assemble in the field and requires modest levels of experience or training. If fasteners are precast into a concrete structure, the installation of mounting plates 42 onto the fasteners merely requires insertion of pad 52, such as a neoprene pad, and shimming to plumb on level surfaces and gentle grades. Either an edge shim or beveled shim plates may be used for shimming to plumb, for example. Once mounting plates 42 are shimmed and fastened to the pavement, the remaining steps quickly erect segments of the railing.

Lower rail 26 is fastened to posts 22. Pickets 23 are then respectively inserted into pre-cut holes 15 in each insert 24 of lower rail 26. Upper rail 26, which may be identical to the lower rail, is fitted onto pickets 23 by aligning holes 15 with pickets 23. The upper rail is then fastened to each post 22. As depicted in FIG. 4B, the post may have a width Y of about four inches (4"), as is conventional in the manufacturing of four-inch C-beam posts, and the top of the post may be pre-cut at a twenty five degree (25°) angle, with the tallest part of post 22 facing rail 26 as depicted in FIG. 3.

As depicted in FIG. 2, several lengths of railing may be joined one to the other at splices 28, which may be formed by lengths of round tubing having a diameter d, as illustrated in FIG. 1B, being inserted and extending into both sides of the rail at each splice between railing segments. An expansion joint may be formed by round tubing fastened, joined or otherwise connected on only one side of the splice. Fastening, joining or otherwise connecting round tubing to both railing segments provides a continuity splice. In one embodiment, the round tubing has pre-formed screw holes which may be threaded. A corresponding hole in a railing may be used to quickly fasten the railing to the round tubing forming a splice without welding.

The end portion of the railing may be fitted with wings or finials 21 by inserting tubing extending from finials 21 into the ends of the last (end of railing) railing segment and coupling said finials to railing 20. Said finials complete the finishing edge of the rails. They slide into place and are secured with self tapping screws.

Circled details A and D in FIG. 2 correspond to the example in FIGS. 4A-D. One or both of rails 36 may be provided with an insert having a rectangular cross section, such as illustrated in FIG. 1B, for example. The rectangular cross section in FIG. 1B is formed by strip 242 joined to insert 24 at least at pre-cut holes 15, where pickets 23 are inserted into rail 36. For example, weld seam 242 is depicted in FIG. 1B for joining strip 242 to insert 24. Other suitable joining methods may be used such as adhesive joining, snap fitting, friction stir welding, and the like. The use of such rail 36 provides an unobstructed length for insertion of a round tube having an external diameter d capable of fitting inside of rail 36, for splicing, reinforcement or the like, allowing pickets 23 to be provided having the same pre-cut length, for example.

In one example, the railing is completely assembled on location in the field without any welding. All of the welding, if any, is completed in advance under controlled conditions during manufacture of the components to be assembled on location. For example, as illustrated in FIG. 1C, cap 12 is coupled to C-beam post 22, which serves to conceal and to prevent access to fasteners 44. Cap 12 may be joined to post 22 after installation and inspection of railings 20. As best illustrated in the example of FIG. 4C, pickets 23 may be spaced at a distance x from posts 22, such as one and one-eighth inches from the front face of the post to the centerline of the picket, for example.

Upper and lower rails 26 are symmetric as depicted in FIG. 1A and include a U-shaped mid-section 86 and opposing flat portions 82 extending from mid-section 86 and inserts 24 having a cross section with a flat mid-region and two opposite flanges extending in a common direction from the flat mid-region, forming an open, rectangular channel. In one example, such as illustrated in FIG. 1C, the open side of insert 24 faces inwardly toward arcuate mid-region 86 of the rails, and pickets 23 are inserted through holes 15 and into the cavity formed by the insert and the rail.

Figure 5:
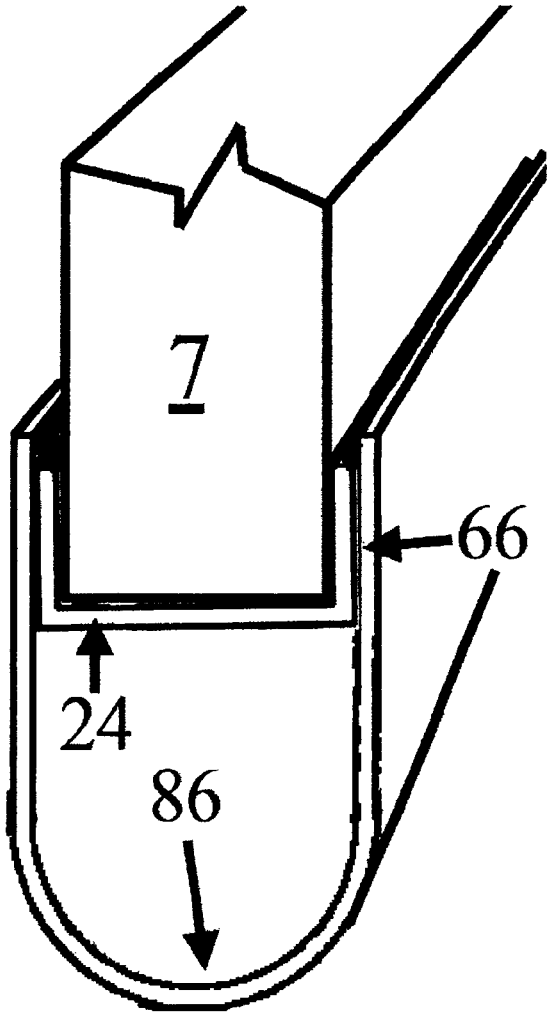
FIG. 5 depicts an embodiment where each insert faces the open end of its associated rail.

As illustrated in the example of FIG. 5, the opening of insert 24 may face outwardly, away from arcuate mid-region 86, forming an open channel capable of receiving panel 7. Panel 7 may replace pickets in a railing for the purpose of providing a guard rail in some applications. For example, panel 7 may include a sound barrier, a decorative motif or a transparent barrier, for example. A panel railing or segment may be assembled similarly to the picket railing, except panel 7 is inserted into the opening of insert 24 which is inverted in the opposite direction to accept the edge of panel 7 into the opening of insert 24. Both upper and lower rails 66 are selected to hold panel 7 when panel 7 replaces pickets 23.

Alternatively, the inserts may be provided in the form of a rectangular tube or a capped channel, as illustrated in FIG. 1B, sized for fitting within the opposite sides of a U-shaped railing.

A plurality of holes may be pre-cut or pre-formed in inserts 24, such as by punching, machining or forming, through the flat mid-region of each of the inserts, at a desired, predetermined spacing, for example. The holes may accommodate the insertion of pickets, which are spaced along the pedestrian railing between the upper rail and the lower rail. A lower insert may be fitted into a lower rail and an upper insert may be fitted into an upper rail. Both of the lower and upper inserts may be attached to the railings by welding, adhesive bonding, brazing, soldering or the like or may be attached by fasteners, such as screws or rivets or may be snap fit or interference fit into rails.

Any handrail may be selected and installed as provided by the manufacturer of the handrail. The handrail preferably attaches to the posts using fasteners, without requiring welding, and the fastener attaching the handrail is concealed within a cavity formed by post 22 and cap 12.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A method for fabricating a railing assembly, comprising the steps of:

providing a lower insert, an upper insert, a lower rail and an upper rail;

forming a plurality of holes in said lower insert and said upper insert;

inserting the lower insert into said lower rail and said upper insert into said upper rail;

providing a mounting plate having at least one opening formed therein;

placing said mounting plate into overlying relation to a support surface;

providing at least one anchor bolt and placing said at least one anchor bolt through said at least one opening to secure said mounting plate to said support surface;

joining a post having at least one flat face onto said mounting plate in upstanding relation thereto;

plumbing the post and the mounting plate relative to said support surface;

securing the lower rail to the post;

securing a flat portion of said lower rail to a flat face of said post;

sizing a plurality of pickets to span a predetermined rail distance between the lower rail and the upper rail;

inserting the plurality of pickets in the holes formed in the lower insert;

positioning the upper insert onto the plurality of pickets, such that the plurality of pickets respectively fit through the holes in the upper insert; and securing the upper rail to the post at said predetermined rail distance.

2. The method of claim 1, wherein the step of securing said flat portion of said lower rail to a flat face of said post further comprises the step of performing said securing in the field at a job site.

3. The method of claim 2, wherein the step of securing the lower rail to the post further comprises the step of:

inserting a carriage bolt through said lower rail and a portion of said post so that said carriage bolt does not rotate, and tightening a nut onto said carriage bolt.

4. The method of claim 3, further comprising the step of:

concealing the nut by non-removably securing a cap onto the post so that there is no access to the nut.

5. The method of claim 4, wherein the step of concealing further comprises the step of:

securing said cap onto said post after said railing assembly is fabricated and inspected.

6. The method of claim 1, wherein the step of joining a post further comprises the step of:

welding said mounting plate to a lower end of said post.

7. The method of claim 6, wherein the step of joining a post further comprises the step of:

fixing a longitudinal axis of the post at an angle other than normal to the face of the mounting plate from which said post extends.

* * * * *